United States Patent [19]

Rolsma

[11] 3,997,899

[45] Dec. 14, 1976

[54] LOW RADAR CROSS-SECTION RE-ENTRY VEHICLE

[75] Inventor: Bernard Rolsma, Rochester, Mich.

[73] Assignee: Chrysler Corporation, Highland Park, Mich.

[22] Filed: Mar. 20, 1961

[21] Appl. No.: 97,097

[52] U.S. Cl. ..... 343/18 A; 102/105

[51] Int. Cl.[2] ..... H01Q 17/00

[58] Field of Search ..... 102/92.5, 49, 56, 105; 343/18 A, 18 E

[56] References Cited

UNITED STATES PATENTS

| | | | |
|---|---|---|---|
| 2,853,946 | 9/1958 | Loedding | 102/49.3 |
| 2,937,597 | 5/1960 | Winn et al. | 102/105 |

OTHER PUBLICATIONS

"*Space Technology*", Aviation Week, 4/21/58, vol. 68, No. 16 (pp. 51–59 relied on).

*Glass Ceramics* , Missiles and Rockets, 7/14/58, vol. 4, No. 2 (pp. 27, 28 & 30 relied on).

*Primary Examiner*—Verlin R. Pendegrass

*Attorney, Agent, or Firm*—Talburtt & Baldwin

EXEMPLARY CLAIM

1. A low radar cross-section re-entry vehicle comprising: a tubular metallic cannister enclosing all instrumentation and payload for said vehicle, said cannister having a diameter of approximately 10 inches and an overall length of approximately 65 inches with a conical portion having an included angle of approximately 26° closing the forward end thereof and a closure at the rear end of said cannister; and an aerodynamic fiberglass superstructure conical in form completely enclosing said cannister with the forward end of said cannister nested in the forward end of said superstructure, said superstructure having an included angle of approximately 26°, a length of approximately 67 inches and a base diameter of approximately 30 inches; said vehicle having its center of gravity closer to the pointed forward end thereof than is the center of pressure thereof.

2 Claims, 1 Drawing Figure

Figure 1:
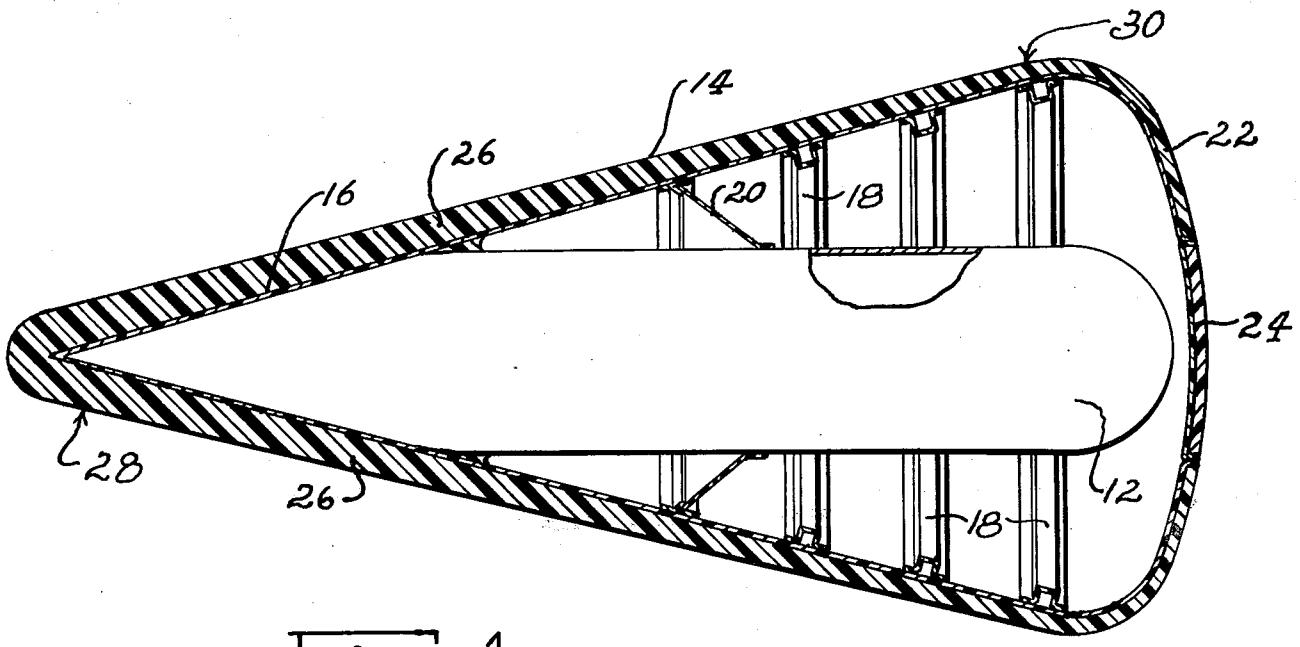

INVENTOR.
BERNARD ROLSMA
BY
Harness and Harris
ATTORNEYS.

LOW RADAR CROSS-SECTION RE-ENTRY VEHICLE

The present invention relates to an improvement in an aeroballistic missile and more particularly to a low radar cross-section re-entry vehicle which, according to present practice, comprises the nose cone of such a missile.

In the present state of the art, interception of a re-entry vehicle or warhead during or shortly prior to re-entry into the earth's atmosphere constitutes a potentially effective defensive technique. In order to intercept an offensive re-entry vehicle the interceptor defensive system must perform several actions successfully and in sequence. For the purpose of this discussion these actions are: detect, track and discriminate, predict, and intercept. That is, initially the defensive system must detect in some manner the presence of the offensive vehicle and it must then track the vehicle during its flight and discriminate the vehicle from potentially large numbers of objects exhibiting similar characteristics. Following or during the discrimination process the defensive system must predict the intended target of the offensive vehicle to determine if defensive interception is warranted. If the decision is made to intercept, the system must also calculate and predict an intercept point toward which the interceptor will be launched and must start the interceptor on its way to that point. Conservative estimates of existing nuclear capability indicate that the actual interception must occur at altitudes greater than 100,000 feet to avoid injury to exposed ground level personnel resulting from the combined detonation of the interceptor and the warhead carried by the offensive vehicle.

On the basis of the above defensive sequence and the capabilities of present interceptors, an effective defensive sequence must be initiated before re-entry of the offensive vehicle. This is because the typical path and speed of such offensive vehicles, for instance an ICBM, provides only approximately 30 seconds between re-entry at 300,000 feet and intercepts at a safe limit of 100,000 feet. Therefore, detection must occur before re-entry to permit adequate time for interception above the minimum safe altitude.

The principal object of the present invention is therefore to provide a re-entry vehicle that is difficult or impossible to detect by radar at least prior to its re-entry into the earth's atmosphere and to minimize the basic radar cross-section during re-entry.

Another object of the present invention is to provide such a re-entry vehicle of an extremely low radar cross-section and which also has an aerodynamically stable configuration so as to be capable of functioning effectively on leaving and re-entering the earth's atmosphere.

Other objects of this invention will appear from the following description with reference to the drawing, wherein:

FIG. 1 is a longitudinal sectional view illustrating a nose cone embodying the present invention.

According to the present invention the pay load, instrumentation, and all other metallic material is enclosed within a metallic container designed to provide minimum radar cross-section and this metallic container is in turn enclosed within a conical superstructure made of material having a low radar cross-section and shaped to provide the proper aerodynamic configuration. The container and the superstructure comprise the low radar cross-section re-entry vehicle which forms the nose cone of an aeroballistic missile.

Referring to the drawings, the re-entry vehicle embodying the present invention comprises a cannister 12 which, by virtue of its shape, has a low radar cross-section and contains therein all of the instrumentation necessary for the re-entry vehicle as well as the nuclear warhead or pay load. The shape of the cannister is dictated by considerations known to those skilled in the art and, in effect, disguises from radar detection devices all of the various elements contained within. The cannister in a typical re-entry vehicle has a diameter of 10 inches and the length of 65 inches. The forward end of the cannister is conical and the rear end is hemispherical. The half-angle of the conical section is 13° thus giving an included angle in the conical section of 26°. The cannister is formed of any suitable lightweight metal having the necessary strength.

In order to provide a suitable aerodynamic shape for the re-entry vehicle the cannister is surrounded by a superstructure 14 which is in the proven aerodynamically proper cone shape. The front end of the cannister is nested into the interior of the front end of the cone, as at 16, and is bonded thereto in any suitable known manner. The cone is provided with suitable low radar cross-section reinforcing ribs 18 one of which is provided with the inwardly extending flange 20 that engages and supports the rear portion of the cannister 12. The cone superstructure 14 is formed of fiberglass which is a material that is practically transparent to radar detection means. The circular reinforcing ribs 18 and the support flange 20 are formed of the same material as is also the hemispherical rear bulkhead 22. The bulkhead is provided with an access door 24 through which access may be had to the cannister 12 and the end of the cannister 12 may in turn by provided with any suitable means to provide access to the interior thereof.

To maintain the proper aerodynamics of the cone, the center of gravity of the cannister and cone must be ahead of the center of pressure. That is, the center of gravity msut be closer to the point of the cone than the center of pressure so that the re-entry vehicle will travel nose forward. The instrumentation and pay load must, of course, also be similarly arranged within the cannister. I have found that an aerodynamically stable cone then has a length to base diameter ratio of 2:1 with an included tip angle of approximately 26°. A typical length cone is 60 inches with a base diameter of 30 inches and the included angle at the tip of the cone of 26°.

In order to protect the re-entry vehicle from the tremendous heat that is developed during its flight through the earth's atmosphere both on exit and re-entry, the fiberglass superstructure 14 is covered with a suitable low radar return ablative material 16. This ablative material serves to maintain the temperature of the interior of the re-entry vehicle below approximately 200° F to prevent damage to the warhead and instrumentation and also to reduce infrared radiation from the vehicle which is another means of defensive detecting of re-entry vehicles. Assuming that the re-entry vehicle is to be a portion of an intercontinental ballistic missile, I have found that a suitable thickness for this ablative material, such as Micarta, is ¾ of an inch at the forward portions of the cone, designated by the arrow 28, and tapering to a thickness of about ¼ inch at the base of the cone and around the rear bulkhead. A suitable ablative material is comprised of 58% melamine resin and 42% fiberglass by weight, has a melting point of 2540° F and a density of 121 lbs. per cubic foot. Such a material is commercially available from Westinghouse Electric Corporation under the trade name Micarta 259-2.

The above described re-entry vehicle has a radar cross-section of the magnitude of $10^{-3}$ square meters for the radar fequencies that are utilized by presently known and proven techniques at illuminating angles from 0° to approximately 60° from nose-on. The illuminating angle is the angle formed by the line of travel of the illuminating waves with the longitudinal axis of the cone, i.e. nose-on is 0°. The range from zero to 60° from nose-on covers the usually known and proven angles that have to be protected against. At these frequencies and within these angles the present techniques allow detection of re-entry vehicles at a range up to approximately 600 miles from re-entry. The re-entry vehicle embodying the present invention presents such an extremely small cross-section to the radar detection units that effective detection thereof is tremendously reduced. The re-entry vehicle described hereinbefore has an effective radar cross-section of approximately 0.001 square meters which is in the order of two magnitudes less than presently conventional re-entry nose cones.

Having thus described my invention, I claim:

1. A low radar cross-section re-entry vehicle comprising: a tubular metallic cannister enclosing all instrumentation and payload for said vehicle, said cannister having a diameter of approximately 10 inches and an overall length of approximately 65 inches with a conical portion having an included angle of approximately 26° closing the forward end thereof and a closure at the rear end of said cannister; and an aerodynamic fiberglass superstructure conical in form completely enclosing said cannister with the forward end of said cannister nested in the forward end of said superstructure, said superstructure having an included angle of approximately 26°, a length of approximately 67 inches and a base diameter of approximately 30 inches; said vehicle having its center of gravity closer to the pointed forward end thereof than is the center of pressure thereof.

2. A low radar cross-section re-entry vehicle comprising: a tubular metallic cannister enclosing all instrumentation and payload for said vehicle, said cannister having a conical portion with an included angle of approximately 26° closing the forward end thereof, a closure member at the rear end thereof, and an overall length approximately six times its diameter; and an aerodynamic superstructure conical in form completely enclosing said cannister and composed of material having an inherent radar cross-section at least as low as that of said cannister, the forward end of said cannister being nested in the forward end of said superstructure, said superstructure having an included angle of approximately 26° and a length of approximately twice its base diameter; said vehicle having its center of gravity closer to the pointed forward end thereof than is the center of pressure thereof.

* * * * *